United States Patent [19]

Steves

[11] Patent Number: 4,967,905

[45] **Date of Patent: * Nov. 6, 1990**

[54] DOOR UNIT INSTALLATION KIT WITH PACKAGING AND DISPLAY CONTAINER

[75] Inventor: Marshall T. Steves, San Antonio, Tex.

[73] Assignee: Steves & Sons, Inc., San Antonio, Tex.

[ * ] Notice: The portion of the term of this patent subsequent to Dec. 5, 2006 has been disclaimed.

[21] Appl. No.: 410,617

[22] Filed: Sep. 21, 1989

Related U.S. Application Data

[63] Continuation-in-part of Ser. No. 47,623, May 7, 1987, Pat. No. 4,884,687.

[51] Int. Cl.[5] ..... B65B 85/64

[52] U.S. Cl. ..... 206/321; 206/325; 206/453

[58] Field of Search ..... 206/321, 325, 443, 449, 206/453, 451

[56] References Cited

U.S. PATENT DOCUMENTS

| | | | |
|---|---|---|---|
| 2,271,632 | 2/1942 | Diehl | 93/93 |
| 2,742,146 | 4/1956 | Lester, Jr. | 206/325 |
| 2,757,854 | 8/1956 | Wall | 206/321 X |
| 2,929,495 | 3/1960 | Simonsen | 206/325 |
| 2,998,132 | 8/1961 | Wilson | 206/321 |
| 3,017,022 | 1/1962 | Amundson | 206/325 |
| 3,111,724 | 11/1963 | Piekarski | 206/325 |
| 3,301,820 | 1/1969 | Haendiges | 206/325 |
| 3,415,367 | 12/1968 | Lynch | 206/321 |
| 4,127,188 | 11/1978 | Heaney | 206/453 |
| 4,193,500 | 3/1980 | Scott | 206/321 X |
| 4,429,791 | 2/1984 | Ruppel et al. | 206/453 X |
| 4,884,687 | 12/1989 | Steves | 206/325 X |

*Primary Examiner*—Paul T. Sewell
*Assistant Examiner*—Jacob K. Ackun, Jr.
*Attorney, Agent, or Firm*—Gunn, Lee & Miller

[57] ABSTRACT

A method for assembling a door unit installation kit, together with a container that allows the kit to be conveniently packaged and displayed. The kit includes a door, jambs and other parts, designed to permit installation of a left or right-handed door, or inward or outward opening door. The container is characterized by at least a cardboard top and cardboard bottom piece that holds these door unit parts together. The cardboard pieces are folable into place around the door unit and have cut-out portions at appropriate locations to hold the door unit part securely in place. The kit is assembled by folding and inserting tabs into locking tab inserts of the container's pieces, and inserting the door unit parts therein.

6 Claims, 4 Drawing Sheets

DOOR UNIT INSTALLATION KIT WITH PACKAGING AND DISPLAY CONTAINER

REFERENCE OF PRIOR PATENTS:

This application is a continuation-in-part of application Ser. No. 07/047,623, filed May 7, 1987, now U.S. Pat. No. 4,884,687 which is incorporated herein in its entirety.

BACKGROUND OF THE INVENTION

1. Field of the Invention:

The present invention generally relates to the field of Packaging, Shipping, and Product Display of Door Units. In particular, it relates to a door installation kit such as may be used for homes and offices. These door kits contain a number of parts necessary for on-site installation, such as the door, a hinge jamb, a strike jamb, a head jamb, a sill, a sweep, molding, and installation strips. The invention consists of a special container that allows the component parts of the kit to be conveniently packaged, displayed and transported.

2. Description of the Prior Art:

A standard method of packaging and shipping doors and other flat ridged articles is to package and ship them in bundles containing a number of such articles. Several types of packaging units are disclosed in the parent application (Ser. No. 07/047,623) of this Continuation-In-Part Application.

SUMMARY OF THE INVENTION

The primary objective of the present invention is to provide a packaging unit to securely transpot and store a complete door installation kit as a unit without damaging the numerous different parts of the door installation kit. The invention provides a means for each door kit to be packaged in a manner such that the various parts will not rattle or rub against each other during storage and transportation.

Furthermore, effective marketing of the door installation kits requires that the aesthetic features of the door itself be visible to prospective purchasers. Thus, another important objective of the invention is to provide a means for packaging complete door installation kits while attractively displaying the door. Other important features of the door unit packaging are that it be lightweight, inexpensive and easy to disassemble.

Past methods of storing and packaging door kits used staples or glue to assemble the door container. However, the use of staples may result in visible damage, as the staples go through the container and into the door and door parts. Although the staples and holes are not visible when the door is installed, potential customers may not realize this and may hesitate in buying the door kit. Using glue to assemble the containers is messy, as glue will ooze out to the sides resulting in an unattractive appearance. Thus, the use of staples or glue to form the containers may deter potential customers from buying the packaged door units. Therefore, it is necessary to improve the present method of assembly so that a neat, attractive appearance is achieved.

The foregoing objectives are achieved in an improved method for assembling a door unit installation kit, together with a container that allows the kit to be conveniently packaged, stored, transported and displayed. The kit includes a door, jambs, and other parts designed for door installation, regardless if it is a left or right-handed door, or inward or outward opening door.

The container is characterized by at least a cardboard top piece and a cardboard bottom piece that holds these kit parts together. The cardboar pieces are foldable and are placed under and around the kit parts, and have cut-out portions at appropriate locations to hold the component parts of the kit securely in place. The container is assembled by folding and inserting tabs into locking inserts in the container pieces, and placing the kit parts therein.

BRIEF DESCRIPTION OF THE DRAWINGS

The novel features believed characteristics of the invention are set forth in the appended claims. The invention itself, however, as well as a preferred mode of use, further objects and advantages thereof, will best be understood by reference to the following detailed description of the illustrative embodiments when read in conjunction with the accompanying drawings, wherein:

DETAILED DESCRIPTION OF THE PREFERRED EMBODIMENTS

Figure 1:
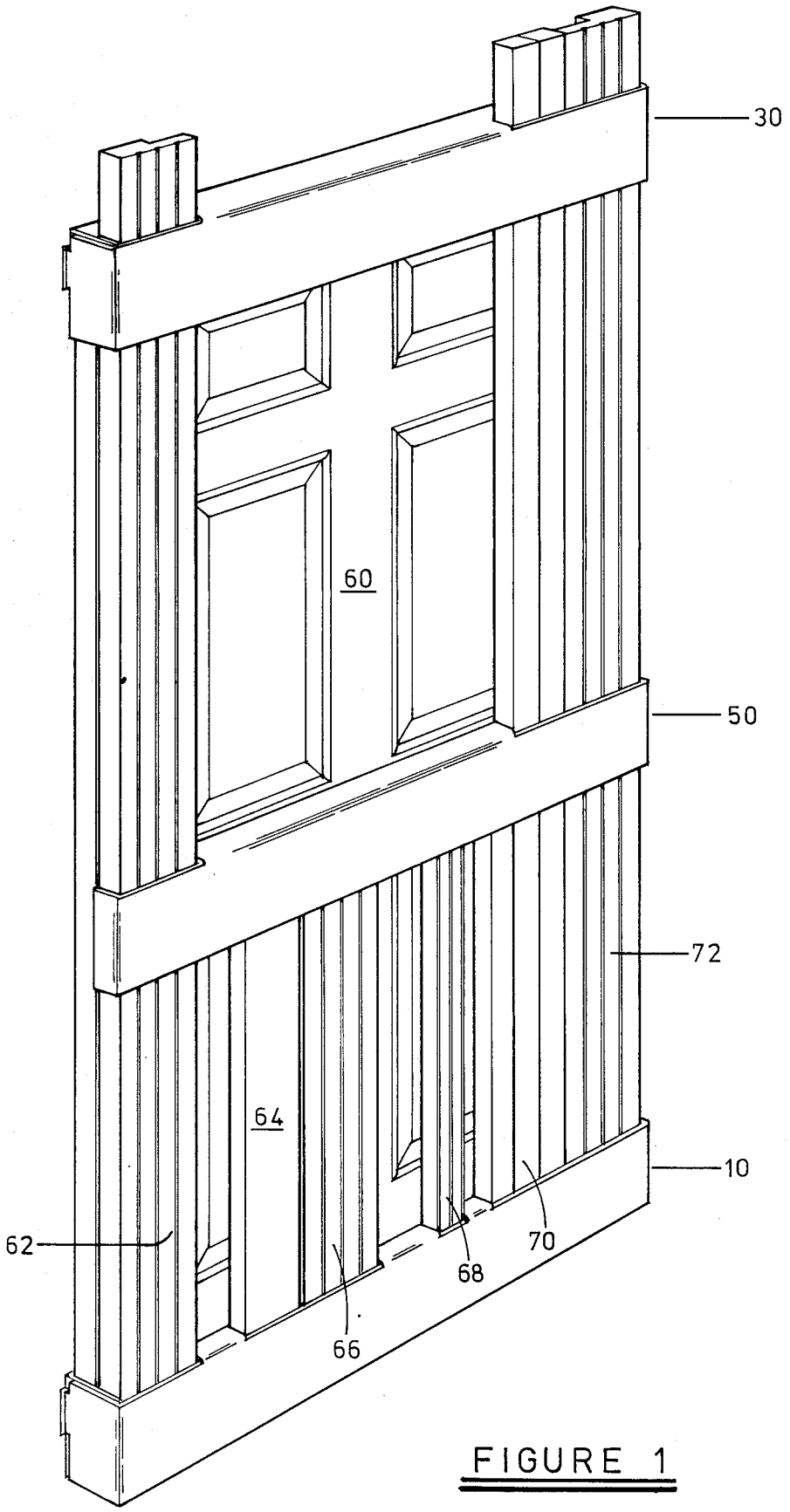
FIG. 1 is a perspective view showing the door unit packaging as used to package a kit.

With reference now to the figures, and in particular with reference to FIG. 1, there is depicted a unit comprised of the door installation kit secured by the packaging, display, storage and transportation container of the present invention. The container has three separate and distinct pieces: the botton piece 10, the middle piece 50, and the top piece 30. Various parts of the door kit are contained within the packaging, as required for the particular installation. In particular, the parts of the kit which may be contained are: door 60, hinge jamb 62, sill 64, head jamb 66, sweep 68, brick mold 70, and strike jamb 72. Brick mold 70 is composed of a top piece and two side pieces. Hardware, which may be used in the installation, can be placed in the enclosed area formed by the bottom piece 10. The container is easily adapted to fit and secure additional parts as may be desired. The additional parts can be stored in bottom unit 10 or the spacers of the bottom unit may be cut out. In the preferred embodiment, the packaging is made from a cardboard material, although other foldable sheet material may be used.

Figure 2:
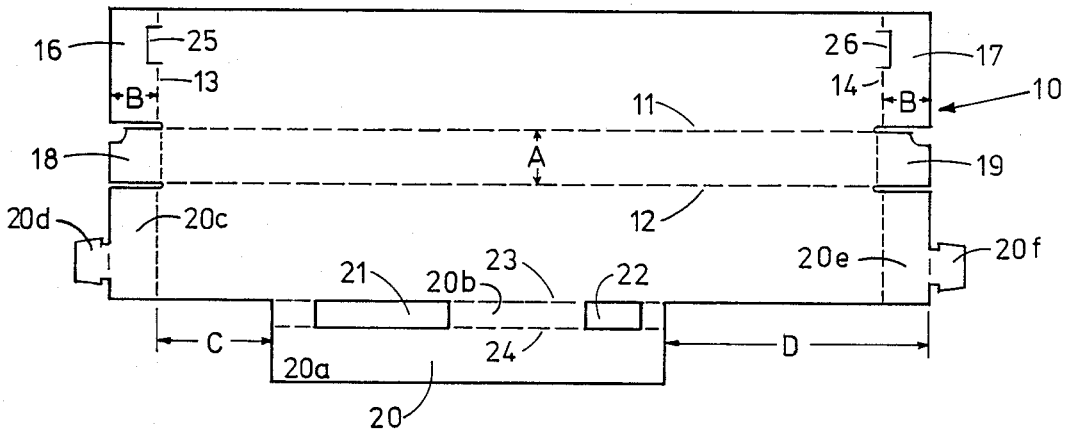
FIG. 2 is a plan view of the bottom piece of the container.

FIG. 2 shows bottom piece 10 being of sufficient dimension so that it may be folded to envelope the bottom end of door 60. The dotted lines represent preformed creases in the foldable sheet material. These creases facilitate the folding of the packaging when placed around the kit components.

Two parallel creases 11 and 12 extend across the bottom piece, parallel to the longitudinal axis thereof, with a distance A between creases 11 and 12. Distance A is approximately the same as the combined thickness of door 60 and the thickness of hinge jamb 62, head jamb 66, or strike jamb 72. Creases 13 and 14 are normal to the longitudinal axis of bottom piece 10, and used to facilitate the folding of side edges of bottom piece 10. Flaps 16 and 17 have tab inserts 25 and 26, respectively, adapted for receiving and locking with tabs **20*d* and 20*f*. The use of staples with the door unit may result in visible damage which will deter potential customers from buying the packaged door units. Therefore, the present improvement is the use of tabs and tab inserts to keep the door packaging unit folded instead of staples or glue as previously used. The width of each flap 16 and 17 is the distance B between the side edge of bottom piece 10 and crease 13 or 14**. Distance B is approximately the same length as distance A.

Bottom spacer 20 extends from the front edge of the bottom piece 10 and has cut-out portions 21 and 22. Cut-out 21 is of slightly larger dimension than the combined widths of sill 64 and head jamb 66, while cut-out 22 is of slightly larger dimension than the width of sweep 68. Pre-formed creases 23 and 24 in bottom spacer 20 facilitate folding. Distance C between bottom spacer 20 and crease 13 is approximately the same as the width of hinge jamb 62. Distance D between bottom spacer 20 and crease 14 is approximately the same as the combined widths of strike jamb 72 and brick mold 70 when placed side by side.

Bottom spacer 20 has a cushion pad **20*a* and holder bar 20*b*. Cushion pad 20*a* provides a cushioning surface between door 60 and the other parts of the door installation kit. Flap 20*c* is located as illustrated and adapted to be folded along crease 13 and has tab 20*d*. Tab 20*d* is designed to be inserted and locked into tab insert 25. Flat 20*e* is capable of being folded along crease 14 and has tab 20*f*, which tab is designed to be inserted and locked into tab insert 26. Once the tabs 20*d* and 20*f* are inserted into their respective tab inserts 25 and 26**, a topless box is formed, which is held together without the use of staples or glue.

Figure 2A:
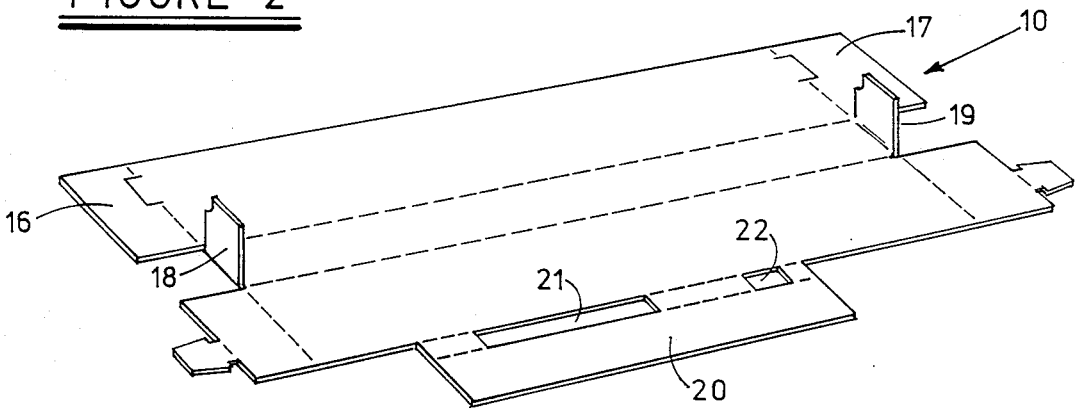
FIGS. 2A, 2B and 2C are a series of perspective views, showing the bottom piece of the container being folded for packaging a door kit.
Figure 2B:
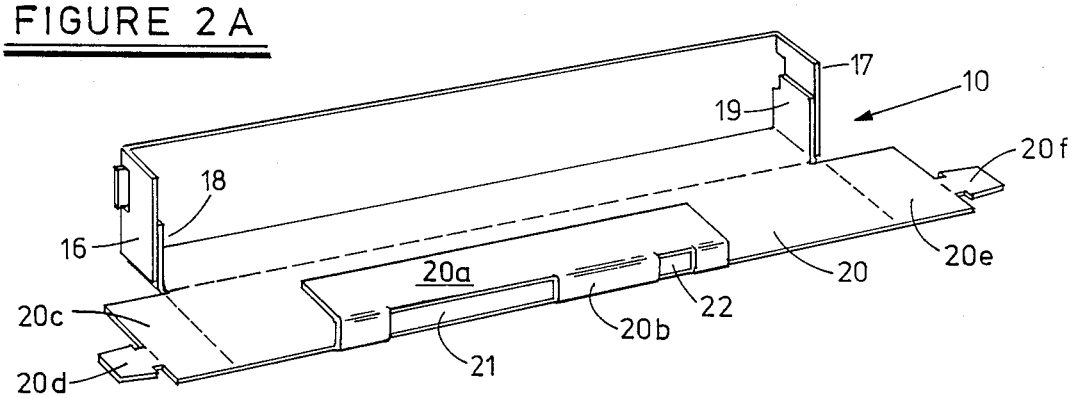
Figure 2C:
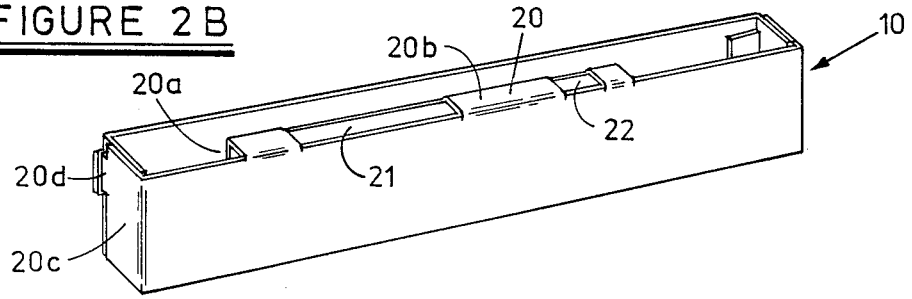

FIGS. 2A, 2B and 2C show sequentially the steps of folding bottom piece 10 so that the door unit kit may be contained therein. All folds are 90° unless otherwise indicated. Tabs 18 and 19 are folded along creases 13 and 14 respectively, as illustrated in FIG. 2A. FIG. 2B shows how bottom spacer 20 is folded along creases 23 and 24, which folding creates cushion pad **20*a* and holder bar 20*b*. The front edge and back side of bottom piece 10 are folded along creases 11 and 12, respectively. Flaps 16 and 17 are folded in against end tabs 18 and 19. Flaps 20*c* and 20*e* are folded in against flaps 16 and 17, as illustrated in FIG. 2C. Tabs 20*d* and 20*f* are then inserted into tab inserts into tab inserts 25 and 26** to form a topples box. The use of tabs allows attachment without staples or glue.

Figure 3:
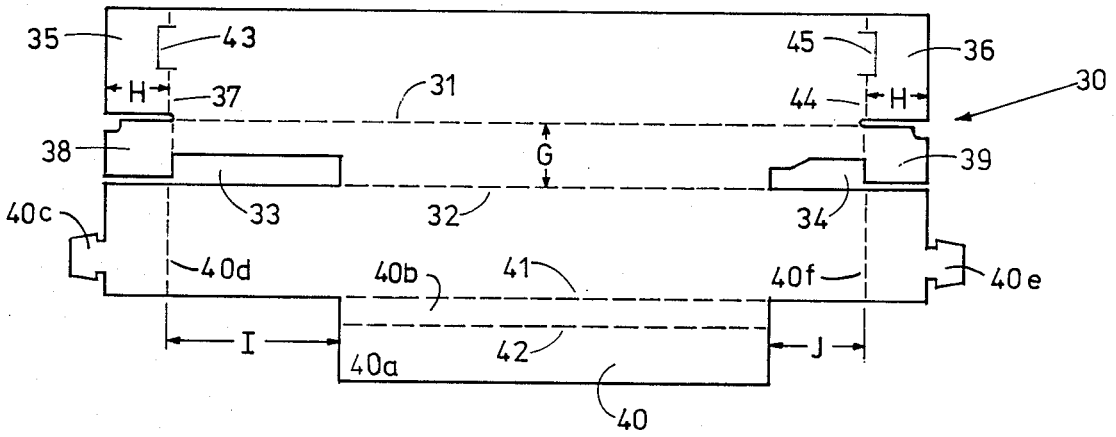
FIG. 3 is a plan view of the top piece of the container.

FIG. 3 shows top piece 30 with the dotted lines representing pre-formed creases in the foldable sheet material. As with the bottom piece, these creases facilitate folding when the top piece is placed around the kit components. Parallel creases 31 and 32 extend longitudinally across top piece 30 with distance G between creases 31 and 32. Distance G is approximately the same distance as the combined thickness of the door and the thickest separate kit piece.

Cut-out portions 33 and 34 are dimensioned to allow taller parts, such as hinge jamb 62 and strike jamb 72 and side pieces of the brick mold 70, to extend through top piece 30 at the point where they are taller than door 60, as shown in FIG. 1. These cut-out portions secure hinge jamb 62 and strike jamb 72 and brick mold 70, and prevent them from moving within the packaging container. The side of cut-out portions 33 and 34 may be modified to accommodate additional tall door parts such as stiff weatherstripping.

Flaps 35 and 36 are located at each side of top piece 30 and defined by means of pre-formed creases 37 and 44. The width of each flap 35 and 36 is the distance H between the side edges of top piece 30 and creases 37 or 44. Distance H is approximately the same as distance G.

Top piece end tabs 38 and 39 are located at each side of top piece 30 and defined by creases 37 and 44. The width of end taps 38 and 39 is approximately the same as width G between creases 31 and 32. The height of tabs 38 and 39 is approximately the same as distance H. Top front spacer 40 extends from the front edge of top piece 30 with creases 41 and 42 to facilitate folding. Distance I between top spacer 40 and crease 37 is approximately the same as the width of hinge jamb 62. Distance J between top spacer 40 and crease 44 is approximately the same as the combined width of strike jamb 72 and the two longer pieces of brick mold 70.

Figure 3A:
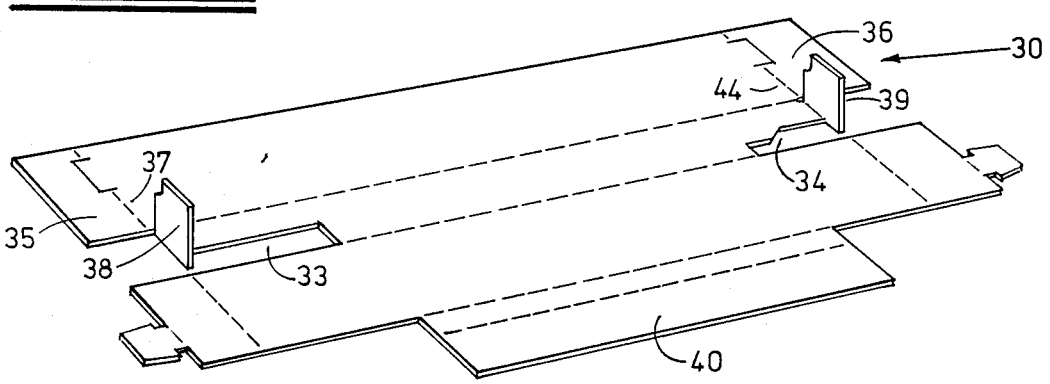
FIGS. 3A, 3B and 3C are a series of perspective views, showing the top piece being folded for packaging a door kit.
Figure 3B:
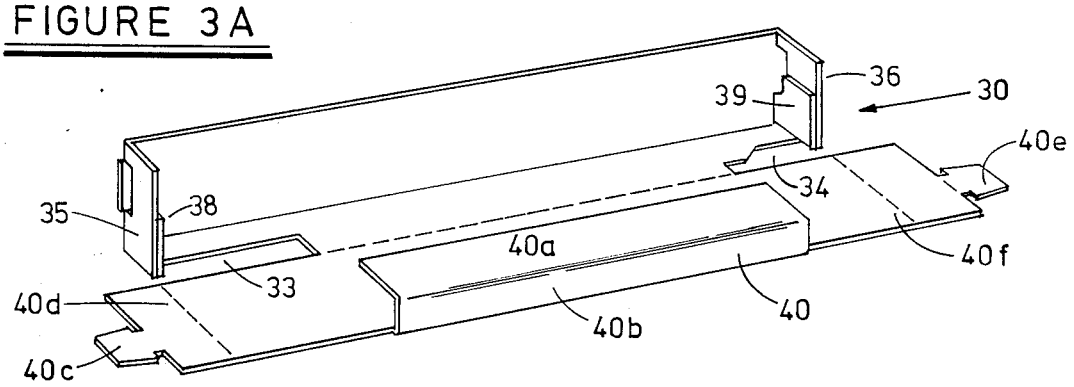
Figure 3C:
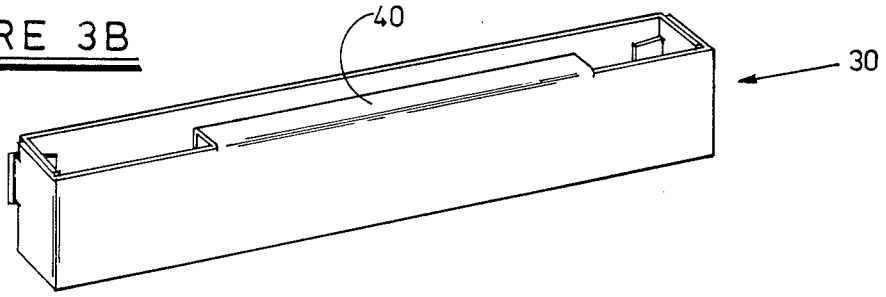

FIGS. 3A, 3B and 3C show sequentially the steps of folding top piece 30 so that the kit may be securely contained therein. Referring to FIG. 3A, tabs 38 and 39 are folded along creases 37 and 44, respectively. Next, top spacer 40 is folded along creases 41 and 42, creating top cushion pad **40*a* and top holder bar 40*b*. Cushion pad 40*a* provides for separation and stabilization to keep door 60 in place. The front and back edges of top piece 30 are folded along creases 31 and 32. Flaps 35 and 36 are folded in against end tabs 38 and 39, respectively. Next, tabs 40*d* and 40*f* are folded in against flaps 35 and 36. Tabs 40*c* and 40*e* are inserted and locked into tab inserts 43 and 45, respectively, thus forming a topless bos. This improved attachment method allows forming top piece 30** into a box without staples, glue or some other fastener.

The door kit parts fit snugly into the box formed by top piece 30. Strike jamb 72 and hinge jamb 62 and the two larger pieces of brick mold 70 extend through cut-out portions 33 and 34, respectively, as shown in FIG. 1. This permits top piece 30 to rest on the top of door 60 is held firmly in place, with respect to the other components of the kit.

Figure 4:
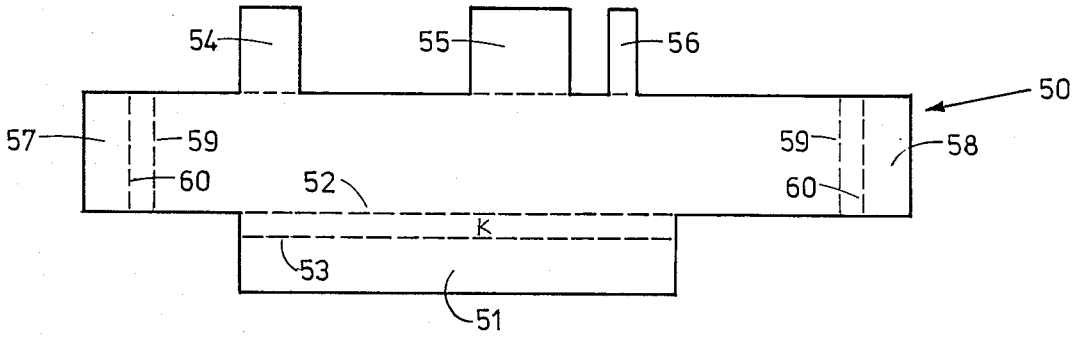
FIG. 4 is a plan view of the middle piece of the container.

FIG. 4 shows middle piece 50 with dotted lines representing pre-formed creases in the foldable sheet material. Middle piece 50 has a front and bacck side with position tabs 54, 55 and 5l extending from the back side at convenient locations to secure the door unit parts.

Middle spacer 51 extends from the front side of middle piece 50. Creases 52 and 53 facilitate folding. Distance K between creases 52 and 53 is approximately the same as the separate thickness of sill 64, head jamb 66 and sweep 68.

Position tabs 54, 55 and 56 extend from the back side of middle piece 50. Position tab 54 is designed to separate hinge jamb 62 from sill 64 and head jamb 66. Position tab 55 is designated to separate sill 64 and head jamb 66 from sweep 68. Position tab 56 is designed to separate sweep 68 from brick mold 70 and strike jamb 72. These position tabs prevent the various kit components from banging and striking against each other. Hinge jamb 62, sill 64, head jamb 66, sweep 68, brick mold 70 and strike jamb 72 each fit securely inside the spaces between the position tabs 54, 55 and 56, when middle piece 50 is folded up.

Figure 4A:
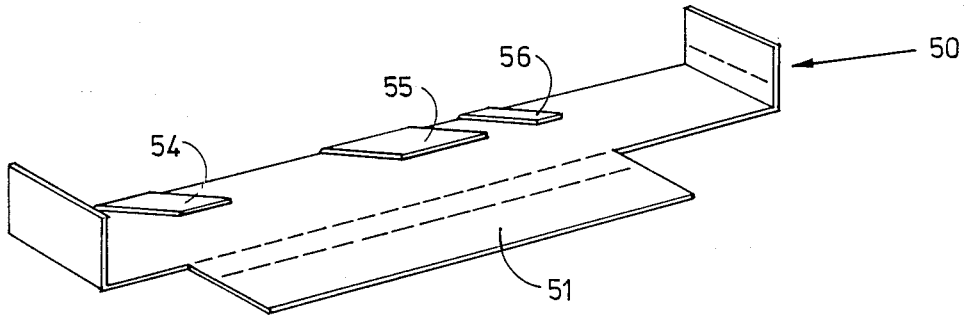
FIGS. 4A and 4B are a series of perspective views, showing the middle piece being folded for packaging a door kit.
Figure 4B:
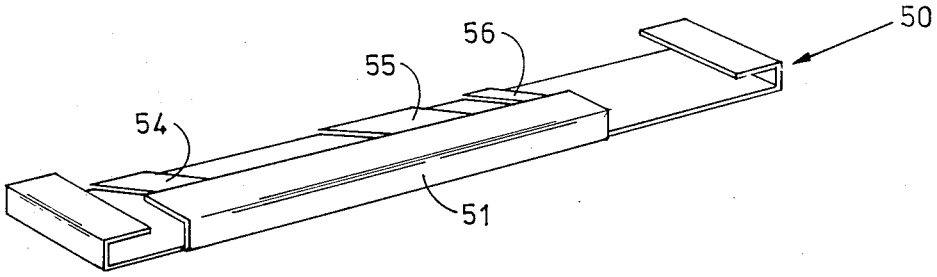

FIGS. 4A and 4B show sequentialy the steps of folding middle piece 50 so that the door kit may be contained therein. First, middle spacer 51 is folded along creases 52 and 53 so as to form a protective cushion between door 60 and the tops of sill 64, head jamb 66, sweep 68 and the smaller brick mold piece 70, as more fully illustrated in FIG. 1. Position tabs 54, 55 and 56 are folded over to an acute angle so that they hold sill 64, head jamb 66, sweep 68 and the smaller piece of brick mold 70 lateraly in place.

End flaps 57 and 58 are folded along creases 59 and 60 so as to form na L shaped side edge with leg portions, as illustrated in FIG. 4B. Leg portions of end flaps 57 and 58 are then placed between the door 60 and hinge jamb 62 and strike jamb 72 as a cushion. Sizing the middle piece 50 properly as set forth above allows a tight fit and provides cushioning between the door 60 and hinge jamb 62 and strike jamb 72.

The method of assembling the door unit installation kit is similar to the method disclosed in the Patent Application, which is incorporated herein for all purpose. The substantial improvement however is that tabs are inserted into tab inserts to form the top piece and bottom piece boxes. These tabs and tab inserts provide a fastening means which does not damage the door and kit parts, whereas the staples or glue disclosed in the Patent Application may have damaged the door unit if not properly assembled.

Although the invention has been described with reference to specific embodiments, this description is not meant to be construed in a limiting sense. Various modifications of the disposed embodiment, as well as alternative embodiments of the invention will become apparent to persons skilled in the art upon reference to the description of the invention. It is, therefore, contemplated that the appended claims will cover such modifications that fall between the true scope of the invention.

I claim:

1. A container for a door installation kit that includes a standard size door and a plurality of jambs, some of which are at least as tall as said door, the container comprising:

A bottom piece, made of a foldable sheet material, said bottom piece sized so that it may be folded to envelope the bottom end of the door, said bottom piece having a front edte, back edge, and two side edges, wherein said side edges each have a pre-cut tab, and tab insert, said bottom piece having a bottom spacer flap extending from said front edge, said bottom spacer flap being foldable to form an L-shaped spacer, said spacer having a plurality of cut-out portions that are sized to allow said door jambs to be inserted therein in an upright position;

A top piece, made of foldable sheet material, said top piece sized so that it may be folded to envelope a top end of said door, said top piece having a front edge, back edge and two side edges, wherein said side edges each have a pre-cut tab and insert.

2. The container of claim 1, wherein said bottom piece and said top piece each have two parallel longitudinal creases to facilitate folding, said creases extending across said top and said bottom piece, the space between such parallel creases being approximately the thickness of the door.

3. The container of claim 1, wherein said top piece has cut-out portions to allow the door jambs to extend through said top piece, thereby locating and securing the door jambs.

4. The container of claim 3, wherein said top piece has a top spacer flap extending from the front side thereof, said top spacer flap being foldable to form and L-shaped spacer that may be inserted between said door and said top piece.

5. A container for a package door unit that includes a door and jambs, which are at least as tall as said door, and one or more shorter door unit parts, which are approximat half as high as said door, comprising:

A bottom piece made of foldable sheet material, such as cardboard, said bottom piece being of sufficiently dimensions so that it may be folded to envelope a bottom end of said door, said bottom piece having a front edge, a a back edge and two side edges, wherein said side edges each have a tab and tab insert, said bottom piece having a bottom spacer flap extending from said front edte, said bottom spacer flap being foldable to form a L-shaped spacer that may be inserted betgween said door and said bottom piece, said spacer having cut-out portions that are of sufficient size to allow said door jambs to be inserted therein in an upright position;

A top piece, made of foldable sheet material such as cardboard, siad top piece being of sufficient dimensions so that it may be folded to envelope a top end of said door, said top piece having a front edge, back edge and two side edges, wherein said side edges each have a tab and tab insert, said top piece having a top spacer flap extending from the front side thereof, said top spacer flap being foldable to form an L-shaped spacer that may be inserted between said door and said top piece;

A middle piece made of foldable sheet material such as cardboard, said middle piece being of sufficient width to allow with middle piece to extend across the door unit to be packaged, said middle piece having a front and back side, said back side having extending position tabs at convenient locations to secure said door unit parts, and said middle piece having side tabs which are folded into L-shaped positions for cushioning between the door and door jambs;

whereby said tabs of said top piece and said bottom piece are capable of being inserted and locked into the respective tab inserts to form said top piece and said bottom piece into boxes for containing the door and the door unit parts.

6. The container of claim 5, wherein said middle piece has a middle spacer flap extending from said front side, said middle spacer flap being foldable to form an L-shaped spacer that may be inserted between said door and the top of said door unit part.

* * * * *